United States Patent [19]

Junghans et al.

[11] Patent Number: 4,896,633

[45] Date of Patent: Jan. 30, 1990

[54] VALVE CONTROL OF INTERNAL COMBUSTION ENGINES BY MEANS OF A ROTARY PISTON PUMP WITH UNEQUAL PUMPING OUTPUT

[75] Inventors: Ewald Junghans, Bergisch Gladbach; Gabriel Tittizer, Roesrath, both of Fed. Rep. of Germany

[73] Assignee: Interatom GmbH, Bergisch Gladbach, Fed. Rep. of Germany

[21] Appl. No.: 237,226

[22] Filed: Aug. 26, 1988

[30] Foreign Application Priority Data

Aug. 26, 1987 [DE] Fed. Rep. of Germany ..... 3728510

[51] Int. Cl.[4] ..... F04C 2/344; F01L 9/02

[52] U.S. Cl. ..... 123/90.12; 123/450; 418/225

[58] Field of Search ..... 123/90.12, 90.13, 90.31, 123/450; 418/161, 225, 29, 150

[56] References Cited

U.S. PATENT DOCUMENTS

| | | | |
|---|---|---|---|
| 2,827,857 | 3/1958 | Eserkaln | 418/29 |
| 3,038,412 | 6/1962 | Clark | 418/225 |
| 3,734,654 | 5/1973 | Burenga et al. | 418/225 |
| 3,776,203 | 12/1973 | Joyce, Jr. | 418/29 |
| 3,791,354 | 2/1974 | Lorentz | 123/90.15 |
| 4,183,723 | 1/1980 | Hansen et al. | 417/288 |
| 4,206,728 | 6/1980 | Trenne | 123/90.12 |
| 4,659,296 | 4/1987 | Bristow | 418/150 |
| 4,802,830 | 2/1989 | Nakajima | 418/150 |

FOREIGN PATENT DOCUMENTS

| | | | |
|---|---|---|---|
| 0191376 | 8/1986 | European Pat. Off. . | |
| 1962323 | 6/1971 | Fed. Rep. of Germany | 123/90.12 |
| 1577994 | 8/1969 | France . | |
| 2480853 | 10/1981 | France . | |
| 2567613 | 1/1986 | France . | |
| 1346842 | 10/1987 | U.S.S.R. | 123/450 |
| 1291719 | 10/1972 | United Kingdom . | |

*Primary Examiner*—Charles J. Myhre
*Assistant Examiner*—Weilun Lo
*Attorney, Agent, or Firm*—Herbert L. Lerner; Laurence A. Greenberg

[57] ABSTRACT

A rotary piston pump assembly includes a rotary piston pump having first, second and third sectors. Pistons successively pass through the first, the second and the third sectors during one rotation. The pump has a pump output equal to zero during passage of the pistons through the first sector.

6 Claims, 2 Drawing Sheets

Figure 1:
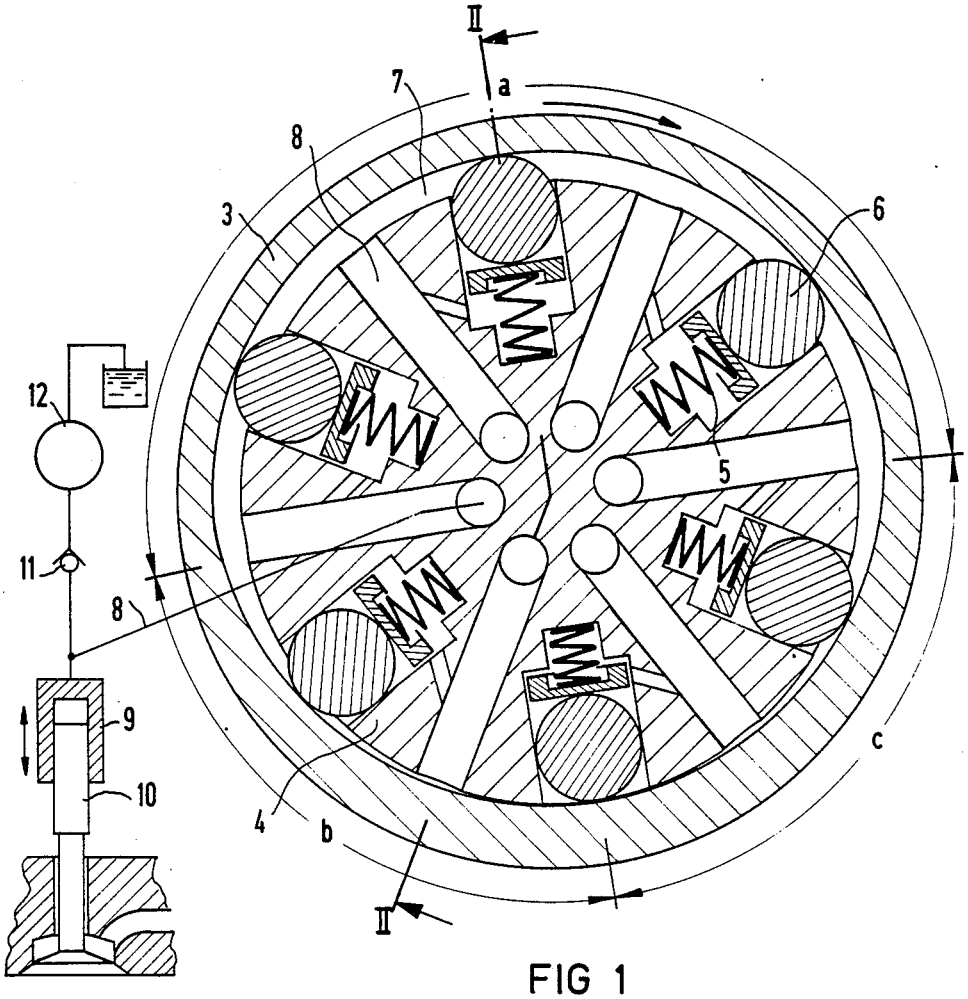

VALVE CONTROL OF INTERNAL COMBUSTION ENGINES BY MEANS OF A ROTARY PISTON PUMP WITH UNEQUAL PUMPING OUTPUT

The invention relates to a rotary piston pump having first, second and third sectors, and pistons successively passing through the first, the second and the third sectors during one rotation, as well as to the connection thereof for controlling the valves of an internal combustion engine.

Published French Patent Application No. 2,480,853 discloses an apparatus controlled by a rotary vane for valve control, in which hydraulically actuated valves acted upon from a central pressure source have characteristics which are varied by creating a passageway for the hydraulic fluid that is variable in accordance with various engine operating parameters, by means of two mutually rotatable links. However, an exact valve control cannot be attained with an apparatus of this kind because of the variable viscosity of the hydraulic fluid at the various operating temperatures of the engine. That apparatus draws the hydraulic fluid which is under pressure from a source which is not described in further detail. One of ordinary skill in the art will preferably select the lubricant oil pump of the engine which is present in any case, as the source. This pump has a pumping characteristic which is as constant as possible, in order to maintain a constant pressure of the oil being pumped. In other words, it operates only as a pressure pump and is not adapted to the needs of the valve control which, during one rotation of the crankshaft, opens the valve during a first period of time, closes it again during a second period of time, and finally keeps it closed during a third period of time.

It is accordingly an object of the invention to provide a valve control of internal combustion engines by means of a rotary piston pump with unequal pumping output or capacity, which overcomes the hereinafore-mentioned disadvantages of the heretofore-known devices of this general type, which has a characteristic that is adapted to this need, which only acts upon the valves intermittently, and which functions as both a pressure pump and a suction pump, these cycles each being associated with one of the valve movements, that is opening or closing. The valve control should take place within a closed loop independent of the lubricant loop of the engine, so that the most suitable fluid can be used in each case for both applications.

With the foregoing and other objects in view there is provided, in accordance with the invention, a rotary piston pump assembly, comprising a rotary piston pump having first, second and third sectors, and pistons successively passing through the first, the second and the third sectors during one rotation, the pump having a pump output or capacity equal to zero during passage of the pistons through the first sector.

If the pump does not produce any pumping output during a portion of its rotation, as required, then during this period of time it develops no action outside the pump.

In accordance with another feature of the invention, there are provided means connected to the rotary piston pump for controlling valves of an internal combustion engine with the pump output. This means that during the aforementioned period of time, no adjusting force acts upon the valves, and the valves remains in their position.

In accordance with a further feature of the invention, the first sector encompasses a portion of one revolution of one of the pistons equal to one revolution of the crankshaft of the internal combustion engine, during which the controlled valves are closed.

In accordance with an added feature of the invention, the pump functions as a pressure pump during the passage of the pistons through the second sector and the pump functions as a suction pump during the passage of the pistons through the third sector. Accordingly, during the remaining period of time the pump operates one-half the time as a pressure pump and one-half the time as a suction pump, so that with the aid thereof, a reciprocating motion can be controlled. For example, a valve can be opened and closed again.

In accordance with an additional feature of the invention, the pistons and the housing define a plurality of pump chambers therebetween, and the number of the pump chambers is equal to the number of the valves to be controlled. Therefore, one such chamber is provided for each of the valves present in multi-cylinder engines, so that the valves are actuated in succession, while being staggered from one another in terms of time, but in the same manner. It may be advantageous to provide a separate pump for each type of valve, that is one for the inlet valves and one for the outlet valves, and these pumps can be integrated into one common housing to provide a double pump.

In accordance with a concomitant feature of the invention, the pump is a roller cell pump. Such a pump has a plurality of individual pump chambers, which are formed by the intervening spaces located between the rollers that act as pistons.

Other features which are considered as characteristic for the invention are set forth in the appended claims.

Although the invention is illustrated and described herein as embodied in a valve control of internal combustion engines by means of a rotary piston pump with unequal pumping output, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
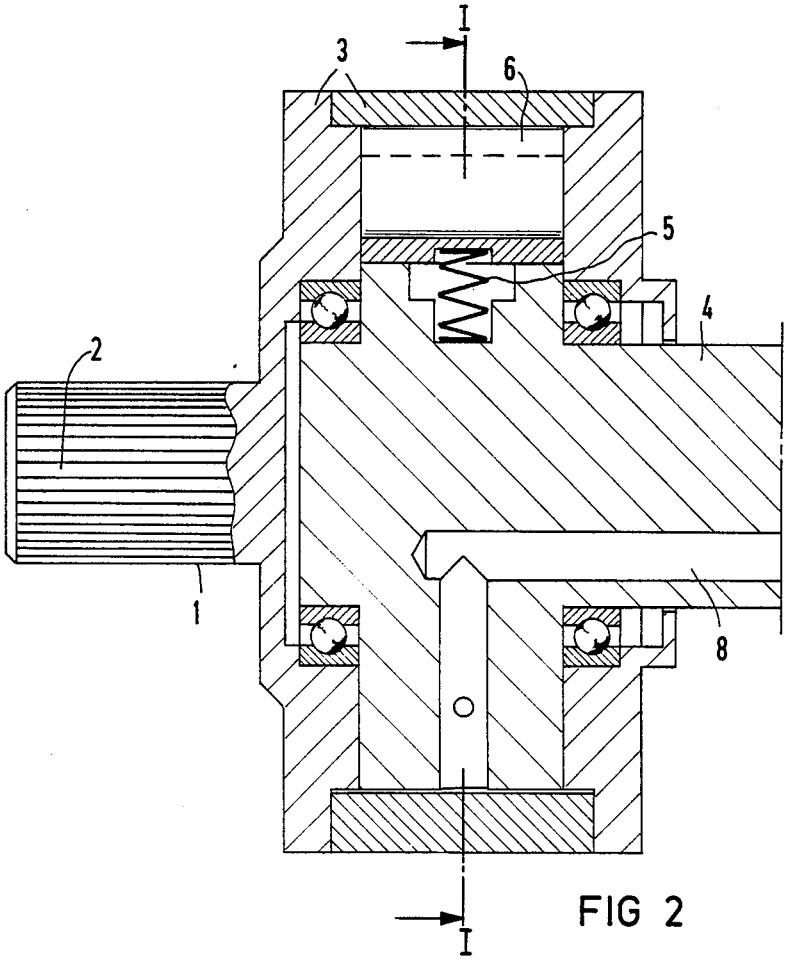

FIG. 1 is a diagrammatic, cross-sectional view of a pump taken along the line I-I of FIG. 2, as well as a fragmentary, sectional view of a valve assembly connected to the pump; and FIG. 2 is a partly broken-away and longitudinal axial-sectional view taken along the line II-II of FIG. 1.

Referring now to FIGS. 1 and 2 of the drawing in detail, there is seen a shaft 1, which may be provided with a set of teeth 2 and which is driven by the non-illustrated crankshaft of an internal combustion engine in any manner known to one skilled in the art which has been developed for driving camshafts. A housing 3 of a roller cell pump is connected to and rotatable with the shaft 1. The housing 3 has an internal contour which takes a different course in three different sectors that are identified by the letters a, b and c in FIG. 1. In the first sector a, the contour is circular and concentric with the axis of the shaft 1. However, in the second sector b and in the third sector c, the contour has courses that converges toward and diverge from a shorter distance from the axis. Overall, the contour is negatively ogival and the mirror image thereof is not unlike that of cams conventionally used for controlling valves. The housing 3 is driven by the shaft 1 and rotates about a fixed pump body 4. Rollers 6 which are loaded by springs 5, protrude from the pump body 4 until they rest on the housing 3. The rollers roll off on the housing 3 upon a rotation of the housing, and act as pistons. A plurality of pump chambers 7 which are separated from one another by the rollers 6, are formed between the housing 3 and the pump body 4 and are filled with hydraulic fluid. If the housing 3 rotates in accordance with the rotational direction indicated by the arrow in FIG. 1, one pump chamber 7 enters into the second sector b, where the internal contour of the housing diverges from the circular form and a compression is then generated in this sector. The compression is propagated through an associated diagrammatically illustrated conduit 8 into an adjusting cylinder 9, in which the shaft of a valve 10 that is constructed as a piston, is positively displaced so that the valve opens. The applicable pump chamber 7 subsequently enters the third sector c, so that the pump develops a suction action, which is likewise imparted to the valve 10, so that the valve closes again. Upon subsequent passage through first sector a, the pump does not develop any action, so that the valve 10 also remains in its closed position. The internal contour of the housing 3 and thus the extent of the individual sectors are defined in such a way that the desired valve characteristic is attained. The pitch of the flank or surface of the contour can be relatively flat, since the pump exhibits an increased capacity because of the greater operative cross section of the individual pump chamber 7, by means of which the required longer valve stroke is effected. In the illustrated embodiment, six pump chambers 7 are provided, which would be required for controlling a six-cylinder engine and for the valves each of one category, that is the inlet or the outlet valves. The valves of the other of these two categories are controlled by a second pump of the above-described type, and the respective housings 3 can be adjusted azimuthally with respect to one another in such a way that a desired variable overlap of the two valve opening times in accordance with the operating state of the engine is attained. In order to compensate for the small leakages arising at the seals of the housing 3 and the valves 10, the respective loop communicates through a check valve 11 with a source 12 of additional hydraulic fluid, which is under pressure.

The foregoing is a description corresponding in substance to German Application P 37 28 510.6, dated Aug. 26, 1987, the International priority of which is being claimed for the instant application, and which is hereby made part of this application. Any material discrepancies between the foregoing specification and the aforementioned corresponding German application are to be resolved in favor of the latter.

We claim:

1. Rotary piston pump assembly, comprising a rotary piston pump having a housing with first, second and third sectors, a pump body with a plurality of radially displaceable pistons successively passing through said first, said second and said third sectors during one rotation, each two of said pistons enclosing a space therebetween forming an independent pumping chamber, and inlet and outlet means communicating with said pumping chambers, each of said pumping chambers having a pump output equal to zero during passage of said enclosing pistons through said first sector.

2. Rotary piston pump assembly according to claim 1, including means connected to said rotary piston pump for controlling valves of an internal combustion engine with the pump output.

3. Rotary piston pump assembly according to claim 2, wherein said first sector encompasses a portion of one revolution of one of said pistons equal to one revolution of the crankshaft of the internal combustion engine, during which the controlled valves are closed.

4. Rotary piston pump assembly according to claim 1, wherein said pump functions as a pressure pump during the passage of said pistons through said second sector and said pump functions as a suction pump during the passage of said pistons through said third sector.

5. Rotary piston pump assembly according to claim 2, wherein the number of said pumping chambers is equal to the number of said valves to be controlled.

6. Rotary piston pump assembly according to claim 1, wherein said pump is a roller cell pump.

* * * * *